US007306702B2

(12) United States Patent
Pease et al.

(10) Patent No.: US 7,306,702 B2
(45) Date of Patent: Dec. 11, 2007

(54) ENZYMATIC PRESS FELT TREATMENT

(75) Inventors: Jacqueline K. Pease, St. Augustine, FL (US); G. Gunar McKendree, Jacksonville, FL (US); Freddie L. Singleton, Switzerland, FL (US); George S. Thomas, West Chester, PA (US)

(73) Assignee: Hercules Incorporation, Wilmington, DE (US)

( * ) Notice: Subject to any disclaimer, the term of this patent is extended or adjusted under 35 U.S.C. 154(b) by 461 days.

(21) Appl. No.: 10/412,512

(22) Filed: Apr. 11, 2003

(65) Prior Publication Data

US 2004/0194903 A1 Oct. 7, 2004

Related U.S. Application Data

(60) Provisional application No. 60/395,289, filed on Jul. 12, 2002.

(51) Int. Cl.
*D21F 1/32* (2006.01)

(52) U.S. Cl. ..... 162/199; 162/158; 162/DIG. 4; 162/272; 162/275; 134/15; 134/21; 435/41; 435/262

(58) Field of Classification Search ..... 162/199, 162/158, DIG. 4, 274, 275, 278; 134/15, 134/21, 26; 435/41–45, 262–266, 277, 278
See application file for complete search history.

(56) References Cited

U.S. PATENT DOCUMENTS 5,961,735 A 10/1999 Heitmann, Jr. et al. ..... 134/15

FOREIGN PATENT DOCUMENTS

| | | |
|---|---|---|
| CA | 2007774 | 7/1990 |
| DE | 400 00 558 A | 7/1990 |
| JP | 63120192 | 12/2001 |
| WO | WO 97/01669 | 1/1997 |
| WO | WO 97/11225 | 3/1997 |
| WO | WO 01 98579 | 12/2001 |

OTHER PUBLICATIONS

P. Pauksta, Survival Techniques: Extending the Life of Press Fabrics, Tappi Journal, Jul. 1997, vol. 80, No. 7, p. 53-59.

*Primary Examiner*—Mark Halpern
(74) *Attorney, Agent, or Firm*—Gary A. Smuels; Joanne Mary Fobare Rossi

(57) ABSTRACT

Methods for reducing or inhibiting deposition on or within press felts to increase the effective life of the press felt and reduce or eliminate the need for batch cleaning are disclosed. The methods disclosed treat press felt while paper is being produced with compositions containing at least one enzyme. Additionally, the enzymes can be applied in combination with other non-enzymatic felt conditioning products either by blending and applying at the same application point or by applying the enzyme and the non-enzymatic felt conditioning product at two different locations along the felt. The treatments are applied continuously or intermittently.

18 Claims, No Drawings

ENZYMATIC PRESS FELT TREATMENT

This application claims priority of U.S. provisional application No. 60/395,289, filed Jul. 12, 2002, the entire contents of which are herein incorporated by reference.

BACKGROUND OF THE INVENTION

1. Field of the Invention

The present invention relates to methods for treating papermaking press felts and reducing or eliminating the need for batch cleaning. More specifically the invention relates to the continuous or intermittent treatment of press felts with enzymes, alone or in combination with felt conditioning chemistries to inhibit deposition or filling on or within the felt structure.

2. Discussion and Background

Paper is produced in a continuous manner from a fibrous suspension (pulp furnish) generally made of water and cellulose fibers. A typical paper manufacturing process consists of 3 stages: forming, pressing, and drying. In the forming stage, dilute pulp furnish is directed on a wire or between 2 wires. The majority of the water is drained from the pulp furnish, through the wire, creating a wet paper web. In the pressing stage the paper web comes in contact with one or generally more porous press felts that are used to extract much of the remaining water from the web. Often the pickup felt is the first felt that the wet paper web contacts which is used to remove the paper web from the wire, via a suction pickup roll positioned behind the felt, and then to transport the paper web to the rest of the press section. The paper web then generally passes through one or more presses each consisting of rotating press rolls and/or stationary elements such as press shoes that are positioned in close proximity to each other forming, what is commonly referred to as, a press nip. In each nip the paper web comes in contact with either one or two press felts where water is forced from the paper web and into the press felt via pressure and/or vacuum. In single-felted press nips the paper web is in contact with the press roll on one side and the felt on the other. In double-felted press nips, the paper web passes between the two felts. After the press section, the paper web is dried to remove the remaining water, usually by weaving through a series of steam heated dryer cans.

Press felts often consist of nylon base fabric generally made of from 1 to 4 individual layers of filaments arranged in a weave pattern. An extruded polymeric membrane or mesh can also be included as one or more of the base fabric layers. Batt fibers, of smaller diameter than the base fabric filaments, are needled into the base on both sides giving the felt a thick, blanket-like appearance. Press felts are designed to quickly take in water from the paper web in the nip and hold the water so that it does not re-absorb back into the sheet as the paper and felt exit the press nip. Press felts are normally an endless loop that circulates continuously in a belt-like fashion between sheet contact stages and return stages. Water pulled into the felt from the paper web at the nip is generally removed from the felt by vacuum during the felt return stage at, what is frequently referred to as, the uhle box.

A variety of materials can be dissolved or suspended in the liquid contained in the paper web when it reaches the press felt and these materials can therefore be transferred into the press felt along with the water extracted from the paper web. Unfortunately some of these materials tend to stay with the press felt and accumulate there instead of being removed with the water at the uhle box. Some of the dissolved or suspended materials that are present in the paper web and can deposit in the felt include components originating from the fibrous pulp such as cellulose fines, hemicelluloses, and sticky components such as wood pitch from fresh wood pulps and glues, resins, and waxes from recycled pulps. Byproducts of microbiological growth such as polysaccharides, proteins, and other biological matter, can also be present in the stock and therefore in the press felts. Various functional additives that are added to paper stock to impart certain properties to the finished paper can also find their way to the press felts. These additives include sizes such as rosin, alkyl ketene dimer (AKD), and alkenyl succinic anhydride (ASA); wet strength resins and dry strength agents for example starch; and inorganic fillers including clay, talc, precipitated or ground calcium carbonate (PCC, GCC), and titanium dioxide. Processing additives used to improve or limit problems during paper production that can also end up in press felts include retention and drainage aids including alum, organic polymers, and various micro-particles; and defoamers, in particular those based on oil.

It is important for efficient paper production, that press felts remain deposit-free. Deposits that form on press felts such as oily or sticky materials can transfer back to the web resulting in dirt spots or holes in the finished paper. They can also cause paper breaks or tears leading to lost production. It is also important for efficient paper production, that press felts remain porous with high void volume. It is highly expensive and energy intensive to evaporate water from paper in the dryer section, making it critical that the press felts remove as much water as possible from the paper web in the press section. Felts that become filled with contaminants that limit water movement through the felt will thus limit the amount of water that can be removed from the web. This will force the machine speed to be slowed in order to allow time for the web to dry in the dryer section. Felts that are unevenly filled can also lead to uneven water removal from the sheet which can result in moisture streaks, wrinkles, and web breaks.

Some hydrophobic materials such as waxes can form a barrier layer at the felt surface preventing water from entering the felt. Other hydrophobic materials, that are tacky or sticky, such as pitch and defoamer oils can increase felt compaction, causing a loss in void volume, thus limiting the amount of water that can enter the press felt. Deposits containing particulate materials on or embedded within the press felt structure can result in significant wear problems limiting the life of the press felt. PCC is particularly problematic, due to its sharp edges and rigid surface that can damage, cut, and prematurely wear out the felt fibers. Some hydrophilic materials such as, starches, proteins, and hemicelluloses tend to exist within the felt in the form of gels that can actually trap water, as well as other depositing materials, within the felt thus limiting the amount of water that can be removed at the uhle box. These hydrophilic gels are particularly problematic in felts since currently used felt conditioning treatments are ineffective at inhibiting them.

It is well known in the art that felt conditioners enhance the performance and extend the effective life of felts by minimizing formation of certain deposits. Felt conditioners are usually liquid blends of surfactants, dispersants and/or polymers most often in water but other solvents are also utilized. Oxidizers, acids, and alkalis can also be contained in felt conditioners, generally in relatively low concentrations. Felt conditioners are applied continuously or intermittently to papermaking felts while paper is being produced through showers during the fabric return stage, while the felt is not in contact with the paper web. These treatments are most often applied on the inside, or machine side, of the felt through low pressure showers, often just prior to a felt carrier roll such that hydraulic force will help move the chemical into the felt to help prevent and remove contaminants that fill the felt. Such treatments are also sometimes applied, through similar showers on the sheet side of the felt after the uhle box and before the nip so that the treatment is present on the surface when contaminants first reach the felt. Additional water showers that are commonly used on press felts and where chemicals could be used include high pressure showers that are usually employed intermittently, so as not to damage the felt, and are most often used on the sheet side to remove surface contaminants. Lubrication showers are also commonly used to apply water at the entrance to the uhle box to prevent wear and provide a seal so that vacuum can remove fluid from within the felt; if desired a chemical treatment could be included within this shower.

When the felts become too filled that they no longer allow for efficient paper manufacture, it becomes necessary to clean them by a process commonly referred to as batch cleaning. When felts are batch cleaned, paper production is stopped, the felt speed is generally slowed, the vacuum at the uhle box is stopped or significantly reduced, and showers are turned off with the exception of the chemical shower. A cleaning solution, generally consisting of high concentrations of caustic, acid, solvent such as kerosene, and/or oxidizer such as hypochlorite, is applied through the chemical shower. After sufficient time for the cleaning solutions to penetrate the filling material, water showers are employed such that the contaminants and batch cleaning chemicals are removed from the felt by vacuum at the uhle box. It is generally necessary to remove the batch cleaning chemicals from the press felt because these materials, at the high concentrations utilized, can damage the press felt if allowed to remain on the felt or can transfer back to the paper altering its characteristics. In some instances it may be necessary to batch clean felts multiple times in a 24-hour production day. Batch cleaning is often necessary, but not a desirable solution since the chemicals used are often hazardous, environmentally unfriendly, and can damage the felt with repeated use. Valuable production time is lost during shut downs for batch cleaning. If such cleaning is unsuccessful, it is necessary to remove the felt, sometimes prematurely, from the paper machine, which is costly from both a time and material perspective.

Continuous and intermittent felt conditioners have been successful at reducing felt filling and increasing time between batch cleanings. However there are still materials that fill felts that are not effectively inhibited by felt conditioning treatments. In particular, existing felt conditioners have limited impact on hydrophilic contaminants such as starch, hemicellulose, and proteinaceous materials which tend to form hydrogels within press felts limiting water movement through the felt and trapping other contaminants. By providing improved felt conditioning methods the frequency of batch cleaning will be reduced. Current felt conditioning practices dictate that a relatively high level of surfactant and/or dispersant must be disposed of since felt conditioners are applied continuously. If sewered, these materials can lead to environmental problems of aquatic toxicity and/or biodegradability. If water from the uhle box containing the conditioners is recycled back into the white water system, surfactants and dispersants are known to lead to problems in paper production such as losses in paper sizing.

It has long been believed that the use of enzymes for felt conditioning was impractical or impossible due to the long reaction times assumed to be required. The general consensus of specialty chemical manufacturers quoted in *Tappi Journal Survival Techniques: Extending the Life of Press Fabrics* (July 1997, Vol. 80, No. 7, p.58) was that the residence time within the fabric was not long enough for enzymes to react with the substrate to achieve significant degradation of the problematic material. The only potentially practical application noted was for use as batch cleaners for washing felts if the enzymes could be used to replace caustic or acid.

The use of enzymes to batch wash paper making felts during a shut-down when paper is not being produced has been disclosed by WO 97/01669 (Mulder) and U.S. Pat. No. 5,961,735 (Heitmann). Mulder teaches the use of cellulase, xylanase, resinase, amylase, and/or Levan hydrolase sprayed on press felts to remove water binders and bound water. During a shut-down, the felt is first washed with acids and/or bases to remove dissolved materials and then rinsed. Next enzymes are applied and allowed to react on the felt for several minutes followed by a second water rinse. Heitmann teaches a similar procedure where an enzyme solution of cellulase and/or hemicellulase is applied to the felt and allowed to remain there for a period of 1 hour, followed by a rinse with distilled water at 70° C. A solution of sodium hydroxide is then applied to the felt to deactivate the enzyme and the felt is then subjected to a tap water rinse lasting 1 hour. Both methods have the disadvantage of increasing the time necessary to clean felts, during which time valuable production would be lost. They also do not reduce or eliminate the harsh chemistries needed for batch washing since both methods require the use of caustic and/or acids. The paper machine can not be used to produce paper while the felt is being treated by either of these methods.

Heitmann notes that the cleaning method as taught in U.S. Pat. No. 5,961,735 could be employed continuously to press felt while paper was being produced. However, the various contact times, the separate feed of enzyme and then caustic to deactivate the enzyme, and the rinse steps using different types of water would be highly impractical, if not impossible, to employ continuously to a paper machine while it was producing paper.

WO 97/11225 (Pärnänen) discloses the use of enzymes applied to unfelted press rolls to improve paper web release from the press roll as the paper exits the press. The enzymes are applied to the press roll through showers commonly used for lubrication prior to the doctor blade and/or to apply release agents to the roll. The enzymes are claimed to improve paper release by removing a film-like layer of deposition formed on the roll due to substances that originated from the paper web. Pärnänen claims that the invention can be applied to clean other moving elements including paper making wires and felts, however there is no description of how this would be accomplished, no teaching or suggestion whether or not the treatment would be continuously applied or used as a batch cleaner. In the only example used to teach the method for cleaning other moving elements, lypase is shown to enhance the removal of deposits from forming wires by first soaking the wire in enzyme solution then by applying a high-pressure water shower to remove the deposit. In the same example a blend of cellulase and hemicellulase is found to be ineffective. A 24 hour soak in enzyme was used. In contrast, lab examples used to correlate to continuous treatment of the center press roll only required a soak time of 1 hour in more dilute enzyme solutions. This would suggest that Pärnänen's method would require a batch cleaning during a shut down for the other moving parts.

An objective of this invention is to improve the performance of existing felt conditioners with enzymes such that these contaminants are better controlled in order to enhance the effective life of press felts. An additional objective is to provide an alternative approach to traditional felt conditioners such that the use of these chemistries can be reduced or even eliminated with the use of enzymes, which can be deactivated and are completely biodegradable.

SUMMARY OF THE INVENTION

The present invention is directed to methods for reducing or inhibiting deposition on or within press felts to increase the effective life of the press felt and reduce or eliminate the need for batch cleaning. More specifically the invention is for applying solutions containing at least one enzyme, continuously or intermittently, to press felts, while paper is being produced to substantially inhibit substances from filling or forming deposits on or within press felts.

The enzymes can additionally be applied in combination with other non-enzymatic felt conditioning products either by blending and applying at the same application point or by applying at two different locations along the felt. In one aspect of the invention the enzymes are applied to the felt as part of a felt conditioning composition comprised of one or more enzymes and one or more non-enzymatic felt conditioning chemistries.

The enzymes of the subject invention are selected from those that will either degrade materials that deposit in or on felts to smaller less problematic materials, or that will prevent depositing materials from gelling, or crosslinking, or from complexing or adhering to other materials within the felt or to the felt itself. Specific types of preferred enzymes include amylases, hemicellulases, cellulases, proteases, and/or lipases.

DETAILED DESCRIPTION OF THE INVENTION

Unless otherwise stated, all percentages are by weight. Unless otherwise stated, when an amount or concentration is given as a list of upper and lower preferable values, this is to be understood as specifically disclosing all ranges formed from any pair of an upper preferred value and a lower preferred value, regardless of whether the ranges are separately disclosed.

Unless otherwise stated, references to percentages of enzymes are by weight of the liquid or granulated form of the enzyme and are not based on the specific activity of that enzyme. Enzymes are available in liquid or granulated forms that vary in activity and the activity of such enzymes can change with time. Enzyme activity is measured using procedures specific to the type of enzyme and reported in units specific to the procedure used. It is understood that the activity of enzymes used in the methods of this invention will be sufficient to produce the desired effect.

The invention provides for a method of inhibiting substances from filling or forming deposits on or within press felts by applying to said felt an effective inhibiting amount of a composition containing one or more enzymes while paper is being produced. The enzymes can be in solid and/or liquid form and blended to form a liquid prior to applying to the felt. The present method is advantageous over other methods in that it can be utilized while the paper is being produced, no shut down of the equipment is necessary, and additional rinses and/or inactivation steps are not necessary.

In another aspect, the invention provides a method of inhibiting substances from filling or forming deposits on or within press felts by applying to the felt, while paper is being produced, an effective inhibiting amount of (a) a composition containing one or more enzymes and (b) a non-enzymatic liquid felt conditioner. The enzymes can be in solid and/or liquid form and blended to form a liquid prior to applying to the felt. The composition containing one or more enzymes can be combined with the felt conditioner prior to application and applied to the felt through the same application system or the composition containing one or more enzymes can be applied at a different location along the felt than the felt conditioner.

In a third aspect, the invention provides a method of inhibiting substances from filling or forming deposits on or within press felts by applying to the felt, while paper is being produced, an effective inhibiting amount of a composition comprising (a) one or more enzymes and (b) one or more non-enzymatic felt conditioning additives. Preferably the composition is a liquid containing about 0.001 to 99% by weight enzymes and about 1 to 99.9% by weight felt conditioning additives. More preferably the composition is a liquid containing about 0.1 to 30% by weight enzymes and about 10 to 60% by weight felt conditioning additives. Most preferably said felt conditioning composition is a liquid containing from about 1 to 20% enzyme and from about 15 to 50% felt conditioning additives.

In a preferred aspect, the invention provides a method of inhibiting substances from filling or forming deposits on or within press felts by applying to said felt, while paper is being produced, an effective inhibiting amount of an aqueous composition. The aqueous composition being comprised of 1 to 20% amylase, 1 to 45% of one or more surfactants, 1 to 30% of one or more anionic or cationic dispersants or polymers, with, if desired, additional enzymes, formulation aids, stabilizers and/or preservatives. The felt conditioning composition is applied to the felt using an aqueous shower on any portion of the felt which it is not in direct simultaneous contact with the paper sheet. The amylase concentration within the shower is from about 1 ppm to about 200 ppm by weight of the aqueous composition.

In any embodiment or aspect of the invention the composition containing the one or more enzymes can additionally contain various formulation aids, stabilizers, and/or preservatives.

Any enzyme that can be applied as a liquid to a press felt on a paper machine, while the paper machine is producing paper, such that the enzyme will act on a substance to remove and/or to inhibit it from depositing on or in the felt, falls within the scope of this invention. Generally preferred enzymes are those that will act on substances that reduce fluid flow through the felt or that will act on materials that form problematic sticky or particulate deposits on or within felts in order to reduce or eliminate such problems. The enzymes useful in the invention can be chosen from enzymes that will either degrade materials that deposit in or on felts to smaller, less problematic materials, or that will prevent depositing materials from gelling, or crosslinking, or from complexing or adhering to other materials within the felt or with the felt itself. Without wishing to be bound by theory it is believed that such enzymes could degrade or break down problematic species into smaller, less problematic materials, by acting on linkages, for example glucosidic, ester, ether, amide, or carbon-carbon double bonds, within the molecules such as with degrading pitch triglycerides to fatty acids or starch to maltose. It is additionally believed that enzymes can act to prevent the formation of problems within the felt, for example by preventing materials from forming gels or forming complexes with other depositing materials, or from cross-linking in the felt such as with wet strength resin, or that will prevent materials from adhering to felt surfaces such as starch. Enzymes are commercially available from companies in liquid or granulate forms. The enzymes of the present invention are generally derived from or modified from bacterial or fungal origins, but could be derived from any other biological origin. One example of an enzyme useful in the invention is lipase. Without wishing to be bound by theory it is believed that lipases inhibit hydrophobic materials from depositing such as from pitch or oils. Additionally examples of enzymes useful in the invention include, but are not limited to, amylases, hemicellulases, cellulases, and/or proteases. Without wishing to be bound by theory, it is believed that amylases, hemicellulases, cellulases, and proteases inhibit hydrophilic gelatinous types of filling. In one preferred embodiment of the invention the enzyme is an amylase.

Commercial liquid enzyme products often contain, in addition to the enzyme concentrate, various diluents and/or preservatives designed to stabilize the enzyme activity and to prevent separation and settling within the liquid. Such materials include, but are not limited to, propylene glycol, sorbitol, glycerol, sucrose, maltodextrin, calcium salts, sodium chloride, boric acid, potassium sorbate, methionin and benzisothiazolinone. These materials as well as other known formulation aids such as defoamers and viscosity modifiers can additionally be present in the felt conditioning compositions of this invention. Other formulation additives are alkanolamines, such as triethanolamine.

The enzymes and/or felt conditioning compositions of the invention can be applied to the felt in any way such that the quantity on or within the felt is sufficient to produce the desired effect. The compositions can be applied at any time to the felt as it rotates in a belt-like fashion between sheet contact stages and return stages. For example the compositions can be sprayed, brushed, rolled, or puddled directly on the felt surface. Another possible method would be to apply the compositions, by similar means, to the various equipment surfaces that come in contact with the felt, such as the felt carrier rolls; the compositions would then be transferred to the felt surface when contact is made between the felt and the treated equipment surface. A portion of the felt can be immersed within a solution of the composition, such as by passing it through a vat containing the composition during the felt return stage, so that the composition is absorbed on or into the felt as the felt passes through the vat. The compositions can also be added to the paper stock system either before the paper web is made or applied to the web just prior to it contacting the felt. In this manner the enzyme compositions enter the felt with the sheet water. In any of these methods, the enzymes and/or felt conditioning compositions of the invention can be applied neat (undiluted) or diluted in a solvent/carrier system. For example the enzyme compositions could be applied to the felt undiluted using an atomized mist spray system. The preferred method would be to apply the enzymes and/or felt conditioning compositions of the invention to the felt using any of the various aqueous low and/or high pressure cleaning or lubrication showers that are commonly used on the machine side and/or sheet side of the felt. The aqueous shower can be applied to the felt at a rate of about 0.01 to about 0.15 gallons per minute per inch width of felt. Preferably the enzyme concentration within the aqueous shower is from about 0.1 ppm to about 1000 ppm by weight, more preferably the enzyme concentration is from about 1 ppm to about 200 ppm by weight.

The composition is applied intermittently or continuously to the felt while the paper is being produced. The composition can be applied either to the machine side of the felt or to the sheet side of the felt or both. The composition is applied to the felt while paper is being made, meaning that the felt is continuously moving and a portion of the felt is in direct simultaneous contact with a portion of the paper at any time. It is preferred that the composition not be applied to the portion of the felt either on the machine side or on the sheet side where the paper and the felt are in simultaneous contact. The liquid containing the enzymes can be applied anywhere on the felt in an area where it is not in simultaneous contact with the sheet on the machine side or on the sheet side.

Felt conditioners useful in the present invention contain one or more surfactants and/or one or more anionic or cationic dispersants or polymers.

When felt conditioners are used in the invention the composition containing the enzyme is applied to the felt in a weight ratio to that of the felt conditioner of from about 1000:1 to about 1:1000. Most preferably the composition containing enzyme is applied to the felt in a weight ratio to that of the felt conditioner of from about 1:1 to about 1:100.

The non-enzymatic felt conditioning additives of the invention are selected from surfactants and/or cationic or anionic dispersants or polymers. Surfactants useful in the invention include but are not limited to alcohol ethoxylates, alkylphenol ethoxylates, block copolymers containing ethylene oxide and propylene oxide, alkyl polyglycosides, polyethylene glycol esters of long chain fatty acids, ethoxylated fatty amines, betaines, amphoacetates, fatty alkyl imadazolines, alkyl amidopropyl dimethylamines, dialkyl dimethyl ammonium chloride, alkyl dimethyl benzyl ammonium chloride, alkyl sulfate, alkyl ethosulfate, alkylbenzyl sulfonate, alkyl diphenyloxide disulfonate, alcohol ethosulfates and phosphate esters. The preferred surfactants are alcohol ethoxylates, alkyl phenol ethoxylates, ethoxylated fatty amines, alkyl polyglycosides, amphoacetates, phosphate esters, and alcohol ethosulfates. Most preferably the composition containing one or more enzymes contains at least one alcohol ethoxylate.

The cationic or anionic dispersants or polymers useful in the invention include but are not limited to naphthalene sulfonate formaldehyde condensate, acrylic acid polymers or copolymers, lignosulfonates, polyvinyl amine, polydiallyl dimethyl ammonium chloride, or polymers obtained by reacting epichlorohydrin with at least one amine selected from dimethylamine, ethylene diamine, dimethylamine proplyamine and polyalkylene polyamine. Most preferably the felt conditioning product contains a naphthalene sulfonate formaldehyde condensate. Most preferably the felt conditioning product contains at least one polymer obtained by reacting epichlorohydrin with at least one amine.

Any felt conditioner or felt conditioning active that can be applied as a liquid to a press felt on a paper machine, while the paper machine is producing paper, such that the conditioner will act on a substance to remove and/or inhibit it from depositing on or within the felt, falls within the scope of this invention. Generally preferred felt conditioners are comprised of surfactants and/or cationic or anionic dispersants or polymers. Examples of suitable felt conditioners and felt conditioning active ingredients that fall within the scope of this invention are disclosed: U.S. Pat. No. 4,715,931 (Schellhamer), WO 95/29292 (Duffy), U.S. Pat. No. 4,895,622 (Barnett), U.S. Pat. No. 4,861,429 (Barnett), U.S. Pat. No. 5,167,767 (Owiti), CA 2,083,404 (Owiti), U.S. Pat. No.

5,520,781 (Curham), U.S. Pat. No. 6,051,108 (O'Neal), U.S. Pat. No. 5,575,893 (Khan), U.S. Pat. No. 5,863,385 (Siebott), U.S. Pat. No. 5,368,694 (Rohlf), U.S. Pat. No. 4,995,994 (Aston), and U.S. Pat. No. 6,171,445 (Hendriks), the entire contents of each is herein incorporated by reference.

Suitable nonionic surfactants include but are not limited to various condensation products of alkylene oxides, preferrably ethylene oxide (EO), with a hydrophobic molecule. Examples of suitable hydrophobic molecules include fatty alcohols, fatty acids, fatty acid esters, triglycerides, fatty amines, fatty amides, alkylphenols, polyhydric alcohols and their partial fatty acid esters. Other examples of suitable nonionic surfactants include polyalkylene oxide block copolymers, ethylenediamine tetra block copolymers of polyalkylene oxide, and alkyl polyglycosides. Preferred nonionic surfactants are fatty alcohol ethoxylates where the alcohol is about $C_{10}$ to $C_{18}$ branched or linear, such as the Surfonice® L (Huntsman Corporation, Houston, Tex.) or TDA series, the Neodol® (Shell Chemical Company, Houston, Tex.) series and the Tergitol® series (Union Carbide Corporation, Danbury Conn.). Other preferred nonionic surfactants include alkylphenol ethoxylates, polyethylene glycol esters of long chain fatty acids, ethoxylated fatty amines, polymers containing ethylene oxide and propylene oxide blocks, and alkyl polyglycosides.

Other suitable felt conditioning surfactants include amphoteric, cationic, and anionic surfactants. Suitable amphoteric surfactants include betaines, sultaines, aminopropionates, and carboxylated imidazoline derivatives. Preferred amphoterics have fatty alkyl chains from about $C_{10}$ to $C_{18}$ and include alkyl betaine, alkyl amidopropyl betaine, sodium alkylamphoacetate, and disodium alkylamphodiacetate. Suitable cationic surfactants include fatty alkyl amines, fatty alkyl imidazolines, amine oxides, amine ethoxylates, and quaternary ammonium compounds having from 1 to 4 fatty alkyl groups on the quarternery nitrogen or dialkyl imidazoline quaternary. Preferred cationic surfactants have fatty alkyl chains from about $C_{10}$ to $C_{18}$ and include fatty alkyl imadazoline, alkyl amidopropyl dimethyl amines, dialkyl dimethyl ammonium chloride, and alkyl dimethyl benzyl ammonium chloride. Suitable anionic surfactants are sulfates, sulfonates, phosphate esters, and carboxylates of the hydrophobic molecules described previously for nonionic surfactants and their condensation products with ethylene oxide. Preferred anionic surfactants include sodium, ammonium or potassium salts of alkyl sulfate, alkyl ethosulfate, alkylbenzyl sulfonate, alkyl diphenyloxide disulfonate, and the acid or salt versions of phosphate esters of alcohol ethoxylates or alkylphenol ethoxylates.

Suitable anionic polymers include but are not limited to polymers based on acrylic acid, methacrylic acid, or other unsaturated carbonyl compounds such as fumaric acid, maleic acid or maleic anhydride and their neutralized versions. These compounds can also be copolymerized with such compounds as polyethylene glycol allyl ether, allyloxy hydroxypropane sulfonic acid, alkenes such as isobutylene, and vinyl compounds such as styrene. Such polymers can additionally be sulfonated. Other suitable anionic polymers include polynaphthalene sulfonate formaldehyde condensate and sulfonated lignins. Preferred anionic polymers are lignosulfonates; polynaphthalene sulfonate formaldehyde condensates having molecular weights from about 400 to 4000, such as Tamol® SN (Rohm and Haas, Philadelphia, Pa.); and polyacrylic or methacrylic acid polymers or copolymers having molecular weights from about 1000 to 100,000, such as the Aquatreat® series (Alco Chemical, A National Starch Company, Bridgewater, N.J.).

Suitable cationic polymers include but are not limited to water soluble cationic polymers that contain amines (primary, secondary, or tertiary) and/or quaternary ammonium groups. Examples of suitable cationic polymers are those obtained by reaction between an epihalohydrin and one or more amines, polymers derived from ethylenically unsaturated monomers containing an amine or quaternary ammonium group, dicyandiamide-formaldehyde condensates, and post cationized polymers. Post cationized polymers include mannich polymers which are polyacrylamides cationized with dimethyl amine and formaldehyde which can then be quarternized with methyl chloride or dimethyl sulfate. Preferred types of cationic polymers derived from unsaturated monomers include polyvinyl amine and polydiallyl dimethyl ammonium chloride. Particularly preferred cationic polymers include those obtained by reacting epichlorohydrin (EPI) with at least one amine selected from the group consisting of dimethylamine (DMA), ethylene diamine (EDA), dimethylamine propylamine, and polyalkylene polyamine. Triethanolamine and/or adipic acid may also be included in the reaction. Such polymers can be linear or branched and partially cross-linked and preferably range in molecular weight from about 1,000 to about 1,000,000. Examples of such cationic polymers are available from Cytec as the Superfloc® (Cytec Industries, Inc., West Paterson, N.J.) C-series.

EXAMPLES

The invention is illustrated in the following examples, which are provided for the purpose of representation, and are not to be construed as limiting the scope of the invention.

Felt conditioning performance was measured using 2 different methods. The first method was used to quantify the weight gain and air porosity loss of new felts exposed to various contaminant systems using Test Apparatus A. The second method examined fluid flow through press felts using Test Apparatus B. Certain contaminants tend to occupy more space while wet and therefore can have a greater detrimental impact on fluid flow through felt than can be quantified with weight gain measurements.

Test Apparatus A is composed of a pneumatically driven piston and alternating centrifugal pumps that feed contaminant and product into a piston chamber which are pressed through new felt samples held within the chamber. Each up/down stroke of the piston completes a cycle and a set number of cycles completes a test run. After drying, measurements are made to determine the weight gained and porosity lost (measured using a Frazier Air Porosimeter) by the felt samples and used to indicate the ability of the treatment to maintain the fabric in its original condition. Low values for percent weight gain and percent air porosity loss are indications of cleaner felts.

Test Apparatus B is composed of a test chamber where clean fabric samples are held. Fluid is pumped at a constant rate in one end of the chamber such that the fluid passes through the felt and out the other side to a collection vessel. As the fabric becomes plugged, back-pressure within the chamber, causes a portion of the fluid flow to be diverted out a relief line, by-passing the felt. A high by-pass flow is an indication of a greater degree of plugging within the felt.

The enzyme solutions, commercially available felt conditioners, and felt conditioning formulations referenced in the examples are described in Tables 1 through 3.

TABLE 1

Commercially Available Liquid Enzymes* Used in Examples

| Enzyme | Description | Activity | Tradename* |
|---|---|---|---|
| E-1 | Bacterial α-amylase | 120 KNU/g | Termamyl ® 120L, L |
| E-2 | Protein engineered α-amylase from genetically modified bacteria | 300 KNU/g | Duramyl ® 300L, DX |
| E-3 | Fungal α-amylase | 800 FAU/g | Fungamyl ® 800L |
| E-4 | Pullulanase, debranching enzyme | 400 PUN/ml | Promozyme ® 400L |
| E-5 | Cellulase | 90 EGU/g | Novozyme ® 342 |
| E-6 | Xylanse | 500 EXU/g | Pulpzyme ® HC |
| E-7 | Lipase | 100 KLU/g | Resinase ® A2X |
| E-8 | Fungal Lipase | | Lipolase ® 100L |
| E-9 | Bacterial protease | 16.0 KNPU/g | Savinase ® 16L |

*Available from Novozymes North America, Franklin, North Carolina)

TABLE 2

Commercially Available Felt Conditioners* Used in Examples

| Product | Aqueous Blend of Components |
|---|---|
| P-1 | Naphthalene sulfonate and phosphate ester |
| P-2 | Polyacrylic acid and nonylphenol ethoxylate |
| P-3 | Lignosulfonate, alcohol ethoxylate and glycol ether |
| P-4 | Alcohol ethoxylate and glycol ether |
| P-5 | Polyamine, alcohol ethoxylate and phosphate ester |
| P-6 | Polyamine and alcohol ethoxylate |

Available from Hercules Incorporated, Wilmington, DE, under the trade name Presstige ®

TABLE 3

Example Formulations

| Formula | Weight % | Components (balance equals water) |
|---|---|---|
| F-1 | 3.1 | Enzyme E-1 |
| | 13.5 | Branched polyamine (DMA/EPI/EDA, 50%) |
| | 8.3 | Linear alcohol ethoxylate ($C_{12}$ to $C_{14}$, 9 EO) |
| | 9.5 | Propylene glycol |
| | 0.07 | Potassium hydroxide solution (45%) |
| F-2 | 3.3 | Enzyme E-1 |
| | 20 | Linear polyamine (DMA/EPI, 40%) |
| | 10 | Linear alcohol ethoxylate ($C_{12}$ to $C_{14}$, 9 EO) |
| F-3 | 3.3 | Enzyme E-1 |
| | 15.3 | Linear polyamine (DMA/EPI, 40%) |
| | 10 | Branched alcohol ethoxylate ($C_{13}$, 8 EO) |
| | 5 | Alcohol ethosulfate ($C_{12}$, 2 EO, 70%) |
| | 10 | Propylene glycol |
| F-4 | 3.3 | Enzyme E-1 |
| | 20 | Linear polyamine (DMA/EPI, 40%) |
| | 10 | Branched alcohol ethoxylate ($C_{13}$, 8 EO) |
| | 10 | Disodium Lauroamphodiacetate (50%) |
| | 5 | Propylene glycol |
| F-5 | 10 | Enzyme E-1 |
| | 20 | Linear polyamine (DMA/EPI, 40%) |
| | 10 | Secondary alcohol ethoxylate ($C_{11}$ to $C_{15}$, 12 EO) |
| | 5 | Disodium Lauroamphodiacetate (50%) |
| | 5 | Propylene glycol |
| F-6 | 10 | Enzyme E-1 |
| | 15 | Linear polyamine (DMA/EPI, 40%) |
| | 10 | Branched alcohol ethoxylate ($C_{13}$, 8 EO) |
| | 15 | Disodium Lauroamphodiacetate (50%) |
| | 10 | Propylene glycol |

TABLE 3-continued

Example Formulations

| Formula | Weight % | Components (balance equals water) |
|---|---|---|
| F-7 | 5 | Enzyme E-1 |
| | 5 | Naphthalene sulfonate formaldehyde condensate |
| | 18.3 | Linear alcohol ethoxylate ($C_{12}$ to $C_{14}$, 9 EO) |
| | 14.3 | Ethoxylated cocoamine (5 EO) |
| | 10 | Propylene glycol |
| F-8 | 10 | Enzyme E-1 |
| | 6 | Naphthalene sulfonate formaldehyde condensate |
| | 16.3 | Linear alcohol ethoxylate ($C_{12}$ to $C_{14}$, 9 EO) |
| | 7 | Alkyl polyglycoside (C8-10, 70%) |
| | 13 | Propylene glycol |
| F-9 | 10 | Enzyme E-1 |
| | 7 | Naphthalene sulfonate formaldehyde condensate |
| | 12.3 | Linear alcohol ethoxylate ($C_{12}$ to $C_{14}$, 9 EO) |
| | 5 | Branched alcohol ethoxylate ($C_{13}$, 8 EO) |
| | 10 | Disodium Lauroamphodiacetate (50%) |
| | 7 | Propylene glycol |
| F10 | 10 | Enzyme E-1 |
| | 20 | Linear polyamine (DMA/EPI, 40%) |
| | 10 | Linear alcohol ethoxylate (C12 to 14, 9 EO) |
| | 2 | Sodium lauryl sulfate (29%) |
| | 10 | Propylene glycol |
| | 0.2 | 1,2-benzisothiazolin-3-one (17%) |
| F-11 | 10 | Enzyme E-1 |
| | 5 | Polyacrylic acid (65%) |
| | 10 | Secondary alcohol ethoxylate (C12 to 15, 12 EO) |
| | 4 | Phosphate ester |
| | 7 | Triethanolamine |
| | 5 | Propylene glycol |
| | 0.2 | 1,2-benzisothiazolin-3-one (17%) |

Example 1

Apparatus B was used to examine how quickly enzymes could remove contaminant that had just plugged a press felt, an important characteristic of an effective continuous felt conditioning treatment. For this stud a solution of cationic potato starch (0.1% STA-LOK® 400, A.E. Staley Manufacturing Company, Decatur, Ill.), typical of the type used in the production of paper, was passed through samples of clean press felt at a flow rate of 1000 ml/min. The by-pass flow and flow through the felt were combined and recirculated through the device until the level of plugging had stabilized, at this time enzymes were added to the recirculation tank and the flow rates were monitored. The enzymes caused a decline in the by-pass flow rate and an increase in the flow rate through the felt that was essentially linear with time. The slope of the flow rate (ml/min) through the felt versus time (min) after the enzyme addition is tabulated in Table 4. The tests were performed at room temperature unless otherwise noted.

TABLE 4

Effect of Amylases and Pullulanase on Starch Contamination in Felts

| | Slope After Treatment with Enzyme Dosage (ppm) | | | | | | | | |
|---|---|---|---|---|---|---|---|---|---|
| Enzyme | 0 | 0.5 | 1 | 3 | 5 | 10 | 15 | 20 | 50 |
| Untreated | 1 | | | | | | | | |
| E-1 | | 2 | 5 | 11 | 22 | 39 | | 73 | |
| E-1, 50° C. | | 15 | 23 | 42 | 48 | | 88 | | |
| E-2 | | 14 | 21 | 59 | | | | | |
| E-2, 50° C. | | 41 | 84 | 145 | 115 | | | | |
| E-3 | | | | 5 | 7 | 13 | | 28 | |
| E-4 | | | | 0 | 2 | 2 | | 3 | 2 |

The data in Table 4 demonstrate that enzymes are capable of rapidly removing a contaminant, such as starch from a press felt thereby restoring fluid flow through the felt. The larger slopes, indicate that the treatment was able to more quickly remove the starch that was plugging flow through the felt. The data also show that pullulanase (E-4), a starch debranching enzyme, was not effective in comparison to the different amylases tested.

Example 2

The same procedure as in Example 1 was utilized to examine the impact of typical felt conditioning additives on felts plugged with starch. The effect of these additives in combination with amylase, Enzyme E-1, was also examined. Additionally the impact of product formulations containing Enzyme E-1 was tested at dosages corresponding to 3 ppm of the amylase. The results are shown in Tables 5a and 5b, respectively.

TABLE 5a

Effect of Typical Felt Conditioning Additives with Amylase On Felt Plugged with Starch

| Felt Conditioning Additive | Slope After Treatment: Treatment | Slope After Treatment: Treatment + 5 ppm E-1 |
|---|---|---|
| None | 1 | 22 |
| 10 ppm Branched alcohol ethoxylate ($C_{13}$, 8 EO) | 3 | 37 |
| 10 ppm Linear alchohol ethoxylate ($C_{12}$ to $C_{14}$, 9 EO) | 3 | 32 |
| 10 ppm Secondary alcohol ethoxylate ($C_{11}$ to $C_{15}$, 12 EO) | 2 | 26 |
| 20 ppm Linear polyamine (DMA/EPI, 40%) | 3 | 25 |
| 20 ppm Branched polyamine (DMA/EPI/EDA, 50%) | 2 | 26 |

TABLE 5b

Effect of Formulations Containing Amylase On Felt Plugged with Starch

| Treatment | Slope |
|---|---|
| Untreated | 1 |
| 3 ppm Enzyme E-1 | 11 |
| 100 ppm Formulation F-1 | 12 |
| 90 ppm Formulation F-4 | 21 |
| 30 ppm Formulation F-6 | 9 |

The data in Tables 5a and 5b show that typical felt conditioning additives had little to no impact on starch filling, however, blends of felt conditioning additives with enzyme had equal or sometimes superior performance to the enzyme alone.

Example 3

The procedure of Example 1 was used to examine the impact of a protease (Enzyme E-9) on felt plugged with proteinaceous material that could be present in felts due to biological activity in paper making stock systems. A solution containing 100 ppm of soy protein concentrate was used as a representative protein in place of the cationic starch previously used. The results are contained in Table 6.

TABLE 6

Effect of Protease on Felt Plugged with Protein

| E-9 Dosage (ppm) | Flow Increase Through Felt (Slope, ml/min/min) |
|---|---|
| 0 | 3 |
| 25 | 20 |
| 100 | 48 |
| 500 | 55 |

The data show that protease is also capable of rapidly removing plugging caused by protein thereby restoring fluid through the felt.

Example 4

To explore if enzymes could minimize or prevent contaminant from plugging a felt, the same device and cationic starch type used in Example 1 were employed, except in this instance the samples were not recirculated through the device. Instead, two test chambers were used with the same container of starch feeding both chambers. T-connections in the back of each unit allowed for a feed of treatment to mix with the contaminant just as it entered the cell. Water was used as the treatment feed for the untreated test chamber and an enzyme solution was used to feed the treated chamber. With this test arrangement, the enzyme and starch had less then 1-second reaction time prior to reaching the felt. The percent of total flow going out the by-pass line is recorded in Table 7 for time periods of 1, 3 and 9 minutes after the start of the test.

TABLE 7

Effect of Amylase at Preventing Starch from Plugging Felt

| | Test Chamber | Average Percent of Flow By-Passing the Felt Due to Starch Plugging: 1 minute | 3 minutes | 9 minutes |
|---|---|---|---|---|
| Enzyme E-2 | | | | |
| 20 ppm | Enzyme | 19 | 35 | 35 |
| | Water | 29 | 34 | 34 |
| 125 ppm | Enzyme | 23 | 20 | 18 |
| | Water | 34 | 37 | 36 |
| 250 ppm | Enzyme | 0 | 0 | 0 |
| | Water | 14 | 30 | 29 |
| 500 ppm | Enzyme | 0 | 0 | 0 |
| | Water | 15 | 37 | 37 |
| 1000 ppm | Enzyme | 0 | 0 | 0 |
| | Water | 26 | 33 | 33 |
| Enzyme E-1 | | | | |
| 150 ppm | Enzyme | 17 | 26 | 25 |
| | Water | 17 | 43 | 43 |
| 300 ppm | Enzyme | 14 | 21 | 21 |
| | Water | 15 | 43 | 43 |
| 400 ppm | Enzyme | 8 | 12 | 11 |
| | Water | 12 | 30 | 30 |
| 625 ppm | Enzyme | 3 | 5 | 4 |
| | Water | 14 | 35 | 34 |

The data in Table 7 show that the test chamber treated with enzyme was most often less plugged than the blank test chamber treated with water. In some instances with enzyme treatment, 100% of the flow was able to pass through the felt. This demonstrates that enzymes such as amylase are capable of preventing or significantly reducing felt filling when applied on a continuous basis to paper making felt.

Example 5

Apparatus B was used to examine the impact of enzymes and felt conditioners, when added as separate product feeds, on components that might plug felts in paper machines producing alkaline printing and writing paper. An aqueous system of components typically used for this paper grade were combined having an actives ratio of: 1 part cationic retention aid, 2 parts each of alum and alkyl ketene dimer (AKD sizing), 20 parts cationic potato starch, and 400 parts precipitated calcium carbonate (PCC) filler. Thirty grams of the system of components were added to water recirculating through clean felts. Commercially used felt conditioning products were added after the flow rates through the felt and bypass had stabilized. After 30 minutes, Enzyme E-1 was added. The data for percent of flow bypassing the felt at the end of each phase of the experiment are contained in Table 8.

TABLE 8

Effect of Separate Feed of Amylase and Felt Conditioners On Filling From Alkaline Printing and Writing Grade Components

| Felt Conditioner | | Enzyme E-1 | Percent of Flow Bypassing the Felt | | |
|---|---|---|---|---|---|
| | | | Due to System | After Felt | After Enzyme |
| ID | ppm | ppm | Components | Conditioner | E-1 |
| Blank | | | 50 | 49 | 49 |
| E-1 only | | 0.5 | 53 | | 47 |
| | | 5 | 54 | | 24 |
| | | 10 | 48 | | 18 |
| | | 25 | 52 | | 11 |
| | | 50 | 50 | | 6 |
| | | 100 | 49 | | 6 |
| | | 250 | 49 | | 5 |
| P-1 | 50 | 5 | 62 | 62 | 27 |
| | 250 | 5 | 61 | 52 | 19 |
| | 500 | 5 | 60 | 53 | 22 |
| P-2 | 50 | 5 | 62 | 59 | 21 |
| | 250 | 5 | 57 | 51 | 14 |
| | 500 | 5 | 60 | 53 | 18 |

TABLE 8-continued

Effect of Separate Feed of Amylase and Felt Conditioners On Filling From Alkaline Printing and Writing Grade Components

| Felt Conditioner | | Enzyme E-1 | Percent of Flow Bypassing the Felt | | |
|---|---|---|---|---|---|
| | | | Due to System | After Felt | After Enzyme |
| ID | ppm | ppm | Components | Conditioner | E-1 |
| P-3 | 50 | 5 | 66 | 66 | 45 |
| | 250 | 5 | 64 | 52 | 31 |
| | 500 | 5 | 63 | 64 | 36 |
| P-4 | 50 | 5 | 62 | 62 | 42 |
| | 250 | 5 | 54 | 54 | 36 |
| | 500 | 5 | 61 | 61 | 42 |
| P-5 | 50 | 5 | 62 | 57 | 43 |
| | 250 | 5 | 55 | 51 | 33 |
| | 500 | 5 | 57 | 54 | 33 |
| P-6 | 50 | 5 | 57 | 58 | 36 |
| | 250 | 5 | 56 | 57 | 37 |
| | 500 | 5 | 61 | 61 | 41 |

The data in Table 8 show that the enzyme was able to improve the performance of all of the different felt conditioners tested by reducing the flow that was by-passing the felt and therefore increasing the flow through the felt. In some instances, in particular with Products P-1 and P-2, the separate feed of enzyme and felt conditioner gave a better increase in fluid flow through the felt than that of the enzyme alone.

Example 6

The alkaline printing and writing grade contaminant system described in Example 5 was used to measure the impact of blending enzyme with felt conditioning products prior to addition to the felt. Weight gain and air porosity loss measurements were conducted using 250 test cycles through Test Apparatus A. Fluid flow studies were conducted using Test Apparatus B with the treatment and contaminant combined at the start of the test. The results are contained in Table 9.

TABLE 9

Effect of Amylase and Felt Conditioners on Filling from Alkaline Printing and Writing Grade Components

| Treatment | Product Ppm | Enzyme Ppm | % Weight Gain Contaminant 60 g inTest | % Porosity Loss Contaminant 60 g inTest | % Weight Gain Contaminant 30 g inTest | % Porosity Loss Contaminant 30 g inTest | % of Flow Bypassing The Felt Contaminant 30 g in Test |
|---|---|---|---|---|---|---|---|
| Untreated | | | 9.5 | 60 | 5.2 | 32 | 58 |
| E-1 | | 5 | 12.5 | 64 | | | 40 |
| | | 12.5 | 11.8 | 72 | | | |
| | | 50 | 12.3 | 72 | | | |
| P-1 | 10 | | 8.0 | 59 | | | |
| | 25 | | 6.6 | 40 | 2.2 | 21 | 69 |
| | 50 | | 1.7 | 2 | | | |
| | 250 | | 0.1 | 2 | | | 45 |
| P-1 + E-1 | 25 | 1 | | | 0.2 | 6 | |
| | 25 | 5 | 0.4 | 7 | 0.7 | 8 | 49 |
| P-2 | 10 | | 11.9 | 70 | | | |
| | 25 | | 5.8 | 33 | | | 53 |
| | 50 | | 6.5 | 41 | | | |
| | 250 | | 6.1 | 18 | | | 56 |

TABLE 9-continued

Effect of Amylase and Felt Conditioners on Filling from Alkaline Printing and Writing Grade Components

| Treatment | Product Ppm | Enzyme Ppm | % Weight Gain Contaminant 60 g inTest | % Porosity Loss Contaminant 60 g inTest | % Weight Gain Contaminant 30 g inTest | % Porosity Loss Contaminant 30 g inTest | % of Flow Bypassing The Felt Contaminant 30 g in Test |
|---|---|---|---|---|---|---|---|
| P-2 + E-1 | 25 | 5 | 5.0 | 27 | | | 29 |
| | 50 | 5 | 0 | 9 | | | |
| P-3 | 10 | | 11.9 | 66 | | | |
| | 25 | | 9.2 | 51 | | | 63 |
| | 50 | | 11.3 | 58 | | | |
| | 250 | | 8.6 | 25 | | | |
| P-3 + E-1 | 25 | 5 | 8.8 | 40 | | | 42 |
| P-4 | 10 | | 7.8 | 71 | | | |
| | 25 | | 7.8 | 39 | | | 67 |
| | 50 | | 6.8 | 51 | | | |
| | 250 | | 4.0 | 15 | | | |
| P-4 + E-1 | 25 | 5 | 8.6 | 37 | | | 47 |
| P-5 | 10 | | 9.1 | 53 | | | |
| | 25 | | 2.3 | 13 | 3.4 | 11 | 59 |
| | 50 | | 7.2 | 46 | | | |
| | 100 | | | | 1.3 | 10 | |
| | 250 | | 3.4 | 26 | | | |
| P-5 + E-1 | 25 | 5 | 3.7 | 15 | 2.0 | 8 | 38 |
| | 25 | 10 | | | 1.1 | 6 | |
| | 100 | 5 | | | 0.5 | 5 | |
| | 100 | 50 | | | 0.4 | 6 | |
| P-6 | 10 | | 6.0 | 41 | | | |
| | 25 | | 4.8 | 24 | 4.4 | 28 | 63 |
| | 50 | | 1.2 | 9 | 4.1 | 25 | |
| | 250 | | 0.3 | 6 | | | |
| P-6 + E-1 | 25 | 5 | 8.2 | 31 | 5.0 | 31 | 38 |
| | 25 | 10 | | | 4.8 | 27 | |
| | 50 | 5 | | | 3.3 | 15 | |

The data in Table 9 show that the enzyme blended with the felt conditioners improved the performance of all of the felt conditioners tested by increasing fluid flow through the felt. In some instances the enzyme also improved the performance of the felt conditioner by further reducing the dry weight gain and air porosity loss beyond what the felt conditioner could have provided.

Example 7

To examine the impact of lipases on pitch deposition in felts, Apparatus A was used with a contaminant system containing a synthetic pitch high in fatty esters and resin acids typical of that which would be found in a newsprint stock produced from groundwood or thermal mechanical pulp. The results are contained in Table 10.

TABLE 10

Effect of Lipase at Controlling Pitch Deposition in Felts

| Felt Treatment | Conditioner ppm | Enzyme ppm | 250 test cycles Weight Gain % | 250 test cycles Porosity Loss % | 100 test cycles Weight Gain % | 100 test cycles Porosity Loss % |
|---|---|---|---|---|---|---|
| Untreated | | | 9.6 | 34 | 3.9 | 16 |
| Enzyme E-7 | | 5 | 13.2 | 51 | | |
| | | 25 | 9.9 | 35 | 2.1 | 17 |
| | | 100 | 9.2 | 38 | 3.9 | 16 |
| | | 500 | 0.9 | 8 | 1.1 | 14 |
| Felt | 25 | | 12.6 | 50 | | |
| Conditioner | 250 | | 6.8 | 28 | 3.8 | 16 |
| P-3 | 500 | | 2.1 | 14 | | |

TABLE 10-continued

Effect of Lipase at Controlling Pitch Deposition in Felts

| Felt Treatment | Conditioner ppm | Enzyme ppm | 250 test cycles Weight Gain % | 250 test cycles Porosity Loss % | 100 test cycles Weight Gain % | 100 test cycles Porosity Loss % |
|---|---|---|---|---|---|---|
| P-3 + E-7 | 250 | 25 | 3.0 | 11 | | |
| | 250 | 100 | 4.5 | 20 | 1.2 | 12 |
| Felt | 25 | | 15.3 | 60 | | |
| Conditioner | 250 | | 2.6 | 12 | 1.1 | 8 |
| P-4 | 500 | | 1.1 | 8 | | |
| P-4 + E-7 | 250 | 25 | 3.1 | 12 | | |
| | 250 | 100 | 3.0 | 11 | 0.9 | 8 |
| Enzyme E-8 | | 500 | 0.8 | 8 | | |

The data in Table 10 show that lipases are capable of reducing pitch deposition in press felts, and in some instances are capable of improving the performance of felt conditioners.

Example 8

To examine the impact of hemicellulase, cellulase, and amylase on felt filling due to carbohydrates that can be present within the felt the methods used in Examples 5 and 6 were employed using various white water samples and a xylan solution (300 ppm). Xylan was used to represent a typical hemicellulose that could be found in paper making pulps. White water is the fluid that drains from the stock in the forming section. As such it would be typical of the fluid remaining with the paper web as it enters the press section.

White water 1 was sampled from a pilot paper machine run of heavy weight board with basis weight of 160 lbs/3000 $ft^2$. The fiber was a blend of hardwood and softwood fibers. Additives were wet strength at 6 lbs/ton, AKD sizing at 5 to 10 lbs/ton and alum at 1 lb/ton, all on an actives basis. White water 2 was sampled from a pilot paper machine run of the white top ply for white top linerboard. The basis weight was 42 lbs/1000 $ft^2$. The fiber was also a hardwood/softwood blend containing 20% PCC. Additives, on an actives basis, were 40 lbs/ton cationic starch, 3 lbs/ton synthetic dry strength, 1 to 3.5 lbs/ton ASA sizing, 1 lb/ton low molecular weight cationic polymer, 0.4 lb/ton anionic retention aid, and 0.5 lb/ton colloidal silica. The results are contained in Table 11.

TABLE 11

Effect of Hemicellulase, Cellulase, and Amylase on Felt Filling

| | | Felt Contaminated First % of Flow Bypassing Felt | | Treatment Added With Contaminant | | |
|---|---|---|---|---|---|---|
| Contaminant | Enzyme | Due to System Components | After Enzyme Addition | % of Flow Bypassing Felt | % Weight Gain | % Porosity Loss |
| Xylan | Untreated | | | 53 | | |
| | 500 ppm E-6 | 53 | 30 | 31 | | |
| | 1000 ppm E-6 | | | 1 | | |
| | 2000 ppm E-6 | | | 0 | | |
| White Water 1 | Untreated | | | | 1.3 | 33 |
| | 100 ppm E-5 | 53 | 50 | | 1.2 | 37 |
| | 100 ppm E-6 | 50 | 46 | | 1.2 | 36 |
| White Water 2 | Untreated | | | | 2.6 | 62 |
| | 100 ppm E-1 | | | | 1.6 | 63 |
| | 100 ppm E-5 | 44 | 41 | | 2.3 | 65 |
| | 100 ppm E-6 | 47 | 40 | | 1.9 | 66 |
| | 100 ppm Blend* | | | | 1.5 | 64 |

*Blend in equal ratio of E-1, E-2, and E-3

The data in Table 11 show that the hemicellulase was capable of removing and reducing or preventing felts from being plugged due to a typical hemicellulose. The hemicellulase and cellulase were also capable of increasing fluid flow through felts plugged with the two samples of white water. The enzymes and, in particular, the enzyme blend were also effective at reducing weight gained by the felt subjected to the white water.

Example 9

Products formulated with amylase were tested with contaminant systems typical of those found producing printing and writing grade paper using the methods of Example 6. Contaminant System A contained 500 ppm of the components and ratios described in Example 5 except starch was combined with the other components after dilution and either added at time 0 or at a time 2 minutes prior to the start of the test. Contaminant System B contained 600 ppm of the components described in Example 6, however the starch was added at a ratio of 1 part to every 24 parts of the other components. The results are contained in Table 12.

TABLE 12

Effect of Formulated Products Containing Amylase on Filling from Alkaline Printing and Writing Grade Components

| | | Weight Gain % | Porosity Loss % | Weight Gain % | Porosity Loss % | Percent of Flow Bypassing the Felt | |
|---|---|---|---|---|---|---|---|
| Felt Treatment | Dosage ppm | Contaminant A Blended 2 min. | | Contaminant B Blended 2 min. | | Contaminant A Blended 2 min. | Contaminant A Blended 0 min. |
| Untreated | 0 | 10.1 | 53 | 10.2 | 38 | 50 | 48 |
| Enzyme E-1 | 1 | | | | | 50 | 33 |
| | 2 | | | | | 57 | 13 |
| | 5 | | | | | 43 | 0 |
| | 10 | | | | | 38 | 0 |
| Formulation F-1 | 50 | 7.3 | 39 | 8.1 | 32 | 36 | 25 |
| | 100 | | | | | 24 | 19 |
| | 150 | 3.4 | 16 | 0.5 | 3 | 21 | 0 |
| | 250 | 2.6 | 12.7 | 0.4 | 3 | 12 | 0 |
| Formulation F-2 | 50 | 9.0 | 45 | 2.0 | 10 | 36 | 33 |
| | 100 | | | | | 21 | 0 |
| | 150 | 7.5 | 35 | 0.8 | 5 | 20 | 0 |
| | 250 | 2.8 | 16 | 0.2 | 3 | 5 | 0 |
| Formulation F-3 | 50 | 8.8 | 46 | 8.9 | 44 | 41 | 34 |
| | 150 | 9.2 | 48 | 6.8 | 35 | 22 | 17 |
| | 250 | 5.7 | 23 | 1.0 | 4 | 6 | 5 |

TABLE 12-continued

Effect of Formulated Products Containing Amylase on Filling from Alkaline Printing and Writing Grade Components

| Felt Treatment | Dosage ppm | Weight Gain % Contaminant A Blended 2 min. | Porosity Loss % Contaminant A Blended 2 min. | Weight Gain % Contaminant B Blended 2 min. | Porosity Loss % Contaminant B Blended 2 min. | Percent of Flow Bypassing the Felt Contaminant A Blended 2 min. | Percent of Flow Bypassing the Felt Contaminant A Blended 0 min. |
|---|---|---|---|---|---|---|---|
| Formulation F-5 | 10 | 7.5 | 34 | | | 44 | 50 |
| | 25 | | | | | | 24 |
| | 50 | 6.0 | 24 | | | 45 | 50 |
| | 100 | 6.5 | 27 | | | 10 | 11 |
| | 150 | | | | | | 0 |
| Formulation F-7 | 25 | 7.8 | 34 | | | 40 | 35 |
| | 100 | 3.8 | 16 | | | 19 | 0 |
| | 150 | 2.8 | 10 | | | 3 | 0 |
| Formulation F-8 | 10 | 7.4 | 33 | | | 37 | 43 |
| | 25 | | | | | | 17 |
| | 50 | 1.2 | 6 | | | 3 | 0 |
| | 100 | 0.7 | 4 | | | 0 | 0 |
| Formulation F-9 | 10 | 5.4 | 21 | | | 43 | 36 |
| | 25 | | | | | | 17 |
| | 50 | 0.0 | 2.7 | | | 31 | 0 |
| | 100 | 0.4 | 3.3 | | | 27 | 0 |

The results in Table 12 show that the felt conditioning products formulated with amylase were effective at both reducing contaminant accumulation on the press felts and at increasing fluid flow through the felts.

Example 10

The felt is treated while paper is being made, with a liquid amylase product and the following felt conditioning formation:

15-30% naphthalene sulfonate
5-20% phosphate ester
0.01% antifoam
water

The two components are combined together and then applied to the felt via an aqueous shower where the amount of amylase in the shower is between 1 to 500 ppm. The ratio of amylase to the felt conditioning formulation is 1 to 100 by weight.

Example 11

The felt is treated while paper is being made, with a two component system the first component being a liquid amylase product and the second component being of the felt conditioning formulation:

15-30% polyacrylic acid, molecular weight ~5000
15-30% nonionic surfactants, either nonyl phenol ethoxylate or alcohol ethoxylates with 9-12 moles EO
0-1% lignosulfonate
1-2% sodium hydroxide
0.025-0.1% biocide
water The two components are applied to the felt separately at different locations on the felt. Each is applied via an aqueous shower. The amount of amylase in the shower is between 1 to 500 ppm. The ratio of amylase to the felt conditioning formulation is 1 to 100 by weight.

Example 12

The felt is treated while paper is being made, with a two component system the first product containing liquid amylase and the second product containing the following formation: 5-15% actives low molecular weight cationic linear or branched polyamine, MW ~13,000 to ~600,000
5-15% alcohol ethoxylate, linear or branched C12-14, 8-9 EO
0-5% phosphate ester
0.025-0.1% biocide
water The two components are combined together and then applied to the felt via an aqueous shower where the amount of amylase in the shower is between 1 to 200 ppm. The ratio of amylase to the felt conditioning formulation is 1 to 50 by weight.

Example 13

The felt is treated while paper is being made, with:

5-20% (actives) linear or branched polyamine, MW ~10,000-50,000 (obtained by reacting epichlorhydrin with dimethylamine and possibly ethylenediamine if branched)
5-20% linear primary or secondary alcohol ethoxylate, C11-15, 9-12 moles EO
0-5% (actives) disodium lauroamphodiacetate
0-10% propylene glycol
0.01-0.10% (actives) 1,2-benzisothiazoline-3-one
3-10% liquid alpha-amylase
water The formulation is applied to the felt via an aqueous shower where the amount of amylase in the shower is between 1 to 200 ppm.

Example 14

The felt is treated while paper is being made, with:

5-10% naphthalene sulfonate formaldehyde condensate
10-20% alcohol ethoxylate(s) C 11-15 linear primary, secondary, or branched, with 8 to 12 moles EO
0-10% (actives) disodium lauroamphodiacetate
0-15% ethoxylated cocoamine
0-10% propylene glycol
0.01-0.05% (actives) 1,2-benzisothiazoline-3-one
3-10% liquid alpha-amylase
water The formulation is applied to the felt via an aqueous shower where the amount of amylase in the shower is between 1 to 200 ppm.

Example 15

The felt is treated while paper is being made, with:

5-20% (actives) linear or branched polyamine, MW ~10,000-50,000 (obtained by reacting epichlorhydrin with dimethylamine and possibly ethylenediamine if branched)
5-20% linear primary or secondary alcohol ethoxylate, C11-15, 9-12 moles EO
0-5% (actives) sodium lauryl sulfate
0-10% propylene glycol
0.01-0.10% (actives) 1,2-benzisothiazoline-3-one
3-10% liquid alpha-amylase
water The formulation is applied to the felt via an aqueous shower where the amount of amylase in the shower is between 1 to 200 ppm.

Example 16

The felt is treated while paper is being made, with:

3-8% (actives) polyacrylic acid, MW ~1000-5000
5-10% triethanolamine
5-15% linear or secondary alcohol ethoxylate, C11-15, 9-12 moles EO
5-10% propylene glycol
0-5% phosphate ester
0.01-0.10% (actives) 1,2-benzisothiazoline-3-one
3-10% liquid alpha-amylase
water The formulation is applied to the felt via an aqueous shower where the amount of amylase in the shower is between 1 to 200 ppm.

Example 17

Felt conditioning products formulated with amylase were compared with commonly used felt conditioners that do not contain an enzyme using different types of contaminant systems and press felts. Two different types of felt were used. Felt type A had a relatively open weave pattern and was a type typically used in the manufacture of packaging grades. Felt type B was of the type used in fine paper manufacture and contained a polymeric membrane as one of its layers. The contaminant systems were prepared as described in Example 9 for system A, however the type of retention aid and sizing were modified as follows:

System 1 is AKD sizing and cationic retention polymer,
System 2 is AKD sizing and anionic retention polymer,
System 3 is ASA sizing and anionic retention polymer, and
System 4 is ASA sizing and cationic retention polymer The result are contained in Table 13.

The data in Table 13 show that the felt conditioning products formulated with enzyme are more effective then felt conditioners that do not contain enzyme by allowing more fluid flow to pass through the felt instead of bypassing it and/or by reducing the amount of weight gained by the felt.

TABLE 13

Effect of Felt Conditioners Formulated with and without Enzyme on Felts Exposed to Different Printing and Writing Grade Contaminant Systems

| | | % Weight Gain | | | | | % Flow Bypassing Felt | | | | |
|---|---|---|---|---|---|---|---|---|---|---|---|
| | | Products with No Enzyme | | | Containing Enzyme | | Products with No Enzyme | | | Containing Enzyme | |
| System | ppm | P-1 | P-2 | P-6 | F-10 | F-11 | P-1 | P-2 | P-6 | F-10 | F-11 |
| System 1, Felt A | 0 | 9.1 | 9.1 | 9.1 | 9.1 | 9.1 | | | | | |
| | 10 | 8.3 | 8.4 | 6.4 | 3.8 | 5.1 | | | | | |
| | 25 | 6.7 | 5.8 | 6.4 | 1.4 | 6.2 | | | | | |
| | 50 | 4.8 | 5.4 | 3.2 | 1.2 | 5.4 | | | | | |
| | 100 | 0.7 | 4.1 | 3.5 | 0.9 | 3.6 | | | | | |
| System 1, Felt B | 0 | 7.4 | 7.4 | 7.4 | 7.4 | 7.4 | 58 | 58 | 58 | 58 | 58 |
| | 10 | | | | 5.6 | 3.4 | | | | | 47 |
| | 25 | 6.3 | 3.5 | 5.1 | 3.6 | 1.9 | | | | 30 | 31 |
| | 50 | 2.7 | | | 3.3 | 1.2 | 53 | 43 | 51 | 21 | 24 |
| | 100 | 0.6 | 2.4 | 3.6 | 1.2 | 0.9 | 42 | 46 | 54 | 12 | 16 |
| | 250 | 0.4 | 1.8 | 2.7 | 0.6 | 0.4 | | | | | |
| | 400 | | | | | | 35 | 42 | 45 | | |
| System 2, Felt B | 0 | 7.2 | 7.2 | 7.2 | 7.2 | 7.2 | 60 | 60 | 60 | 60 | 60 |
| | 10 | | | | 4.8 | 5.5 | | | | | |
| | 25 | 5.9 | 3.9 | 4.5 | 4.1 | 2.6 | | | | 63 | 31 |
| | 50 | 4.1 | | | 1.9 | 3.3 | 47 | 46 | 50 | 47 | 27 |
| | 100 | 1.0 | 2.8 | 2.7 | 0.7 | 0.0 | | | | 29 | 20 |
| | 250 | 0.7 | 1.3 | 3.2 | 0.0 | 0.0 | 16 | 29 | 42 | 3 | 0 |
| System 3, Felt A | 0 | 9.7 | 9.7 | 9.7 | 9.7 | 9.7 | | | | | |
| | 10 | 7.2 | 5.8 | 8.5 | 5.9 | 8.4 | | | | | |
| | 25 | 9.4 | 6.4 | 7.6 | 4.6 | 4.6 | | | | | |
| | 50 | 4.8 | 8.8 | 6.8 | 2.8 | 1.9 | | | | | |
| | 100 | 2.5 | 7.4 | 5.8 | 1.4 | 1.0 | | | | | |
| System 3, Felt B | 0 | 7.3 | 7.3 | 7.3 | 7.3 | 7.3 | 57 | 57 | 57 | 57 | 57 |
| | 10 | | | | 4.0 | 3.6 | | | | | |
| | 25 | 4.8 | 3.9 | 6.6 | | | | | | 45 | 45 |
| | 50 | | | | 1.0 | 1.2 | 49 | 44 | 49 | 46 | 27 |
| | 100 | 1.2 | 3.4 | 4.0 | | | 37 | | | 25 | 30 |
| | 150 | | | | 0.6 | 0.6 | | 41 | | | 29 |
| | 250 | 0.6 | 1.8 | 5.0 | | | | 54 | | 21 | 0 |
| | 400 | | | | | | 34 | 44 | 49 | | |
| System 4, Felt B | 0 | 7.3 | 7.3 | 7.3 | 7.3 | 7.3 | 52 | 52 | 52 | 52 | 52 |
| | 10 | | 5.8 | | 5.4 | 3.2 | | | | | |
| | 25 | 6.8 | 3.1 | 5.3 | | 1.6 | | | | 26 | 33 |
| | 50 | 3.0 | | | 1.7 | 2.6 | 55 | 44 | | 22 | 26 |
| | 100 | 1.0 | 2.0 | 4.5 | | | | | | 9 | 24 |
| | 150 | | | | 2.8 | 1.7 | | | | | |
| | 250 | 0.4 | 1.1 | 3.1 | | | | | | 0 | 27 |
| | 400 | | | | | | 45 | 39 | 36 | | |

What is claimed is:

1. A method for inhibiting substances from filling or forming deposits on or within press felts by applying to said felt, while paper is being produced, an effective inhibiting amount of a composition (a) one or more enzymes and (b) one or more non-enzymatic felt conditioning additives, wherein the concentration of the one or more enzymes is from about 0.1 ppm to about 1000 ppm; wherein the one or more enzyme comprises 1-20% amylase; wherein the one or more non-enzymatic felt conditioning additives comprises 1-45% of one or more surfactants, and 1-30% of one or more anionic or cationic polymers.

2. The method according to claim 1 wherein the composition contains approximately 0.001 to 99% by weight enzymes and 1 to 99.9% by weight felt conditioning additives.

3. The method according to claim 1 wherein the composition contains approximately 0.1 to 30% by weight enzymes and 10 to 60% by weight felt conditioning additives.

4. The method according to claim 1 wherein the composition contains from 1 to 20% enzyme and from 15 to 50% felt conditioning additives.

5. The method according to claim 1 wherein the one or more enzymes are selected from those that degrade materials that deposit in or on felts to smaller, less problematic materials, or that prevent depositing materials from gelling, or crosslinking, or from complexing or adhering to other materials within the felt or to the felt itself.

6. The method according to claim 1 wherein at least one enzyme of the one or more enzymes is a lipase.

7. The method according to claim 1 wherein at least one of the non-enzymatic felt conditioning additives is selected from surfactants, anionic polymers, or cationic polymers.

8. The method according to claim 7 wherein at least one of said surfactants is selected from alcohol ethoxylates, alkylphenol ethoxylates, block copolymers containing ethylene oxide and propylene oxide, alkyl polyglycosides, polyethylene glycol esters of long chain fatty acids, ethoxylated fatty amines, betaines, amphoacetates, fatty alkyl imidazolines, alkyl amidopropyl dimethylamines, dialkyl dimethyl ammonium chloride, alkyl dimethyl benzyl ammonium chloride, alkyl sulfate, alkyl ethosulfate, alkyl benzyl sulfonate, alkyl diphenyloxide disulfonate, and/or phosphate esters.

9. The method according to claim 7 wherein at least one of said anionic or cationic polymers is selected from naphthalene sulfonate formaldehyde condensates, acrylic acid polymers or copolymers, lignosulfonates, polyvinyl amine, polydiallyl dimethyl ammonium chloride, or polymers obtained by reacting epichlorohydrin with at least one amine selected from dimethylamine, ethylene diamine, dimethylamine proplyamine and polyalkylene polyamine.

10. The method according to claim 1 wherein said composition contains at least one surfactant selected from alcohol ethoxylates, alkyl phenol ethoxylates, ethoxylated fatty amines, alkyl polyglycosides, amphoacetates, phosphate esters, and/or alcohol ethosulfates.

11. The method according to claim 1 wherein the one or more non-enzymatic felt conditioning additive comprises an alcohol ethoxylate.

12. The method according to claim 1 wherein the one or more non-enzymatic felt conditioning additive comprises a naphthalene sulfonate.

13. The method according to claim 1 wherein the one or more non-enzymatic felt conditioning additive comprises a polymer obtained by reacting epichlorohydrin with at least one amine selected from dimethylamine, ethylene diamine, dimethylamine proplyamine and polyalkylene polyamine.

14. The method according to claim 1 wherein said composition is applied to the felt continuously or intermittently as an aqueous shower.

15. The method according to claim 14 wherein the enzyme concentration within the aqueous shower is from about 0.1 ppm to about 1000 ppm.

16. The method according to claim 14 the enzyme concentration within the aqueous shower is from about 1 ppm to about 200 ppm.

17. The method according to claim 14 wherein the aqueous shower is applied to the felt at a rate of about 0.01 to 0.15 gallons per minute per inch width of felt.

18. A method for inhibiting substances from filling or forming deposits on or within press felts by applying to the felt, while paper is being produced, an effective inhibiting amount of an aqueous composition, said composition comprising 1-20% amylase, 1-45% of one or more surfactants, 1-30% of one or more anionic or cationic polymers, said composition being applied to the felt using an aqueous shower such that the amylase concentration within the shower is from about 1 ppm to about 200 ppm by weight.

* * * * *